US007628391B2

(12) United States Patent
Zuleger et al.

(10) Patent No.: US 7,628,391 B2
(45) Date of Patent: Dec. 8, 2009

(54) TAPED BAG FEEDER

(75) Inventors: David Lawrence Zuleger, Kaukauna, WI (US); Steven John Schult, Omro, WI (US); Kenneth Eugene Nowak, Green Bay, WI (US)

(73) Assignee: Curwood, Inc., Oshkosh, WI (US)

( * ) Notice: Subject to any disclaimer, the term of this patent is extended or adjusted under 35 U.S.C. 154(b) by 214 days.

(21) Appl. No.: 11/527,000

(22) Filed: Sep. 26, 2006

(65) Prior Publication Data

US 2008/0073836 A1 Mar. 27, 2008

(51) Int. Cl.
*B65H 5/00* (2006.01)

(52) U.S. Cl. ..... 271/1; 271/9.1

(58) Field of Classification Search ..... 271/1, 271/9.1

See application file for complete search history.

(56) References Cited

U.S. PATENT DOCUMENTS

| | | | | | |
|---|---|---|---|---|---|
| 3,782,069 | A | * | 1/1974 | Fischbein et al. | 53/67 |
| 3,908,343 | A | * | 9/1975 | Farrelly | 53/385.1 |
| 4,003,782 | A | * | 1/1977 | Farrelly | 156/552 |
| 4,113,139 | A | * | 9/1978 | Berry et al. | 221/1 |
| 4,435,944 | A | * | 3/1984 | Meyer | 53/531 |
| 4,516,384 | A | | 5/1985 | Imperiale | |
| 4,616,472 | A | | 10/1986 | Owensby et al. | |
| 4,693,372 | A | | 9/1987 | O'Neill | |
| 4,796,412 | A | | 1/1989 | O'Neill | |
| 5,402,625 | A | | 4/1995 | Halstead | |
| 5,826,405 | A | * | 10/1998 | Killinger et al. | 53/459 |
| 2002/0130058 | A1 | * | 9/2002 | Carson et al. | 206/390 |
| 2003/0009990 | A1 | | 1/2003 | Main et al. | |
| 2003/0029141 | A1 | | 2/2003 | Townsend | |
| 2003/0037510 | A1 | | 2/2003 | McGrane et al. | |
| 2003/0154692 | A1 | | 8/2003 | Parsons et al. | |
| 2004/0154689 | A1 | | 8/2004 | Brahier et al. | |
| 2006/0000565 | A1 | | 1/2006 | Billebault et al. | |
| 2007/0210201 | A1 | * | 9/2007 | Palumbo | 242/530.3 |

FOREIGN PATENT DOCUMENTS

| | | | | |
|---|---|---|---|---|
| EP | 0 396 838 | B1 | | 10/1989 |
| EP | 0 265 989 | B1 | | 9/1990 |
| GB | 2064477 | A | * | 6/1981 |
| GB | 2 176 460 | A | | 12/1986 |
| WO | WO 2004/031036 | A1 | | 4/2004 |

* cited by examiner

*Primary Examiner*—Patrick H Mackey
*Assistant Examiner*—Howard Sanders
(74) *Attorney, Agent, or Firm*—Tom J. Hall

(57) ABSTRACT

A taped bag feeder having a housing with a bag guide positioned thereon, a drive mechanism, a first reel and second reel for supplying an assembly of imbricated taped bags to a packaging operation. The assembly of imbricated taped bags having a pair of tape strands connected to the first and second reels which are rotated by the drive mechanism thereby advancing the assembly. The first and second reels being disposed on a face of the bag feeder parallel to and spaced from a longitudinal axis defined by an upstream end and downstream end of the bag guide.

18 Claims, 5 Drawing Sheets

TAPED BAG FEEDER

TECHNICAL FIELD

The present disclosure relates to the field of packaging machinery. Specifically, the present disclosure is for a feeding mechanism used in supplying imbricated, or shingled, taped bags to a packaging machine.

BACKGROUND OF THE INVENTION

Taped bags and machinery using such bags are generally well known in the art. For example, U.S. Pat. No. 3,587,843 discloses a chain of imbricated bags connected and supported by two strands of tape; U.S. Pat. No. 3,698,547 discloses a packaging apparatus having imbricated bags connected by two strands of tape which are attached to a rotatable spool; U.S. Pat. No. 4,032,038 discloses a taped bag dispenser having a wind-up surface; U.S. Pat. No. 4,796,412 discloses a taped bag feeder having the take-up reels housed within a cassette; and British Patent Application GB 2 064 477 A discloses taped bag dispenser with a drive means for imparting rotational motion to take-up reels.

Typically taped bags are made from various thermoplastic materials. Common thermoplastic materials known in the art include polyethylenes, polyesters, ethylene vinyl alcohols (EVOH), and other polymers known in the art which may be configured alone or in combination depending on the desired properties of the packaging material. Taped bags are supplied in a folded or rolled arrangement with the leading end, typically the open end of the bag, configured in an imbricated, or shingled, arrangement with the leading edge of a subsequent bag offset behind the leading edge of a previous bag. Typically, a pair of tapes is provided to advance the bags into machinery that inserts product into the bag. Taped bag packaging equipment is commonly used in food packaging applications, particularly meat packing.

Taped bag feeders are used throughout meat packaging plants to aid in loading products efficiently into an opened bag. These taped bag feeders utilize bags that are shingled on evenly spaced tape. By using the tape as an advancing mechanism, the taped bag feeder, by use of a drive unit, can ensure an opened bag is always ready for an operator or machine to place product into. The drive mechanism on the taped bag feeder is coupled to take-up reels to draw the bags forward. The tapes are removably attached to the bags by adhesive or other means. When product has been inserted into a bag, the bag is peeled away from the tapes and moved to the next stage in the packaging operation.

Most packing plants are very cramped and do not leave very much space for workers and thoroughfares. One major problem with current taped bag feeders in the industry is that the take-up reels are aligned concentrically with the output shafts of the drive. This means that there is a take-up reel on each side of the taped bag feeder. Since many of these taped bag feeders are part of full production lines, it is hard to access the non-operator side reel. This costs valuable production time as workers need to walk around to the nearest opening or stoop below low conveyors to access the non-operator side reel. In a typical packaging operation, taped bags must be reloaded into the machine at periodic intervals, commonly every 30-45 minutes at a minimum. Therefore, an operator must access the take-up reel on the non-operator side of the machine to empty the accumulated tape and to feed the new tape for the next batch of bags. Production time is consumed in accessing the rear reel.

Another reason for the present invention is that some automated pieces of equipment are beginning to use taped bag feeders integrated into the machines. Due to the design of these complete packaging systems, access to the back-side is limited or fully guarded. Mounting the taped bag feeder on carriage rails is one option, but this adds much cost to the overall equipment. Additionally, the use of carriage rails is not a desirable option because of housekeeping and sanitation concerns, especially in food packaging applications. Carriage rails provide surfaces for the accumulation of dust, dirt, food scraps, or other contaminants, and require labor intensive cleaning. This adds much expense and requires workers to remove the whole tape bag feeder from the machine every time access is required at the back-side reel. Therefore, it is desirable for an easier way to allow workers to access the take-up reels without hindering production up-time.

Additionally, the current method of changing and or splicing tape on the non-operator side take-up reel of standard taped bag feeders was not very effective. Operators often have to crawl under very low conveyors or walk to a catwalk in order to reach the opposing tape reel located on the opposite side of the line. This can cause back strain as well as cross contaminate production areas as an operator may come in contact with the floor or peripheral area. Operator safety, coupled with additional machine down-time is why the present invention is desired.

SUMMARY

In view of the foregoing discussion, it is desirable for a taped bag feeder having both take-up reels accessible to an operator. This is accomplished by positioning both take-up reels on one side of the machine that is along side the bag flow path rather than in-line with the flow path. In other words, the take up reels may be positioned on the side of the feeder rather than on the downstream end.

One embodiment of the present disclosure incorporates a timed drive pulley arrangement attached to parallel shafts. By keeping the pulley ratio the same between the two shafts, a 1:1 windup ratio could be maintained between the two take-up reels. By bringing the second parallel shaft back through the body of the taped bag feeder, both reels could be placed on the operator side of the machine.

To further simplify the design, a second embodiment of the present disclosure incorporates a direct drive gear system internal to the taped bag feeder. This allows for a smaller package, and a more dependable drive arrangement. An intermediate parallel shaft is incorporated with a free-turning spur gear to ensure the secondary take-up reels rotate in the same direction and for ease of threading by the operator.

The major benefit of the present disclosure is that both reels of the taped bag feeder are located on one side of the unit, the operator side. Therefore, when a worker needs to obtain access to the tape reels, they do not have to take extra time out of production to go around to the opposite side of the machine. This is typically done when the carrier tape breaks, box of bags needs to be changed, or simply the tape needs to be emptied from the tape reels.

The taped bag feeder of this disclosure also allows the machine to be placed against a wall or other equipment that does not allow rear access for tape reel removal. Formerly, this was not possible or the machine had to be moved to gain access.

The device of the present disclosure can be used to advance shingled tape bags for a worker in a meat packing plant. The device may include a bag guide whereby bags are brought over the guide and the tape threaded over the properly spaced tape guide slot. The spaced tape guide may include various slots to run the tape through depending on the tape spacing when attached to the bags. The tape is then fed through the round tape guides and presented to the take-up reels. A simple knot is tied in the end of each tape strand and slid into the slot in the outer reel, knot facing out. The tape that is threaded through the round tape guide closest to the side-plate gets attached to the reel closest to the side-plate. The second tape running through the other round tape guide gets attached to the second reel. As bags are pulled off the tape over the bag guide, a sensor located atop the guide prompts the drive mechanism to advance the tape forward by means of the take-up reels. Thus, the bag-train advances forward, pulling up the next bag to be inflated and then filled with product.

A compressed gas stream is used to separate the bag mouth and inflate the bag. In one embodiment, an air amplifier or nozzle located upstream of the bag opening is used to open the bag and maintain it in its opened state. This air supply can run continuously for fast paced operations, or be activated via sensor means to save utility costs on slower equipment. An operator or machine is then able to push product into the opened bag and remove the bag from the tape. The product is then free to move to downstream packaging equipment. In addition to air, certain other compressed gasses may be used to open the bags, such as nitrogen, carbon dioxide, or other gasses depending on the desired atmosphere within the final package.

The device of the present disclosure was specifically designed for use in taped bag feed operations, but might be adapted to other uses. This concept could be applied to rewinding of scrap or trim from a manufacturing process.

One aspect of the present disclosure is a taped bag feeder having a housing with an upstream end, a downstream end and a longitudinal axis therebetween which defines a direction of flow or a drive path for a bag, a drive mechanism operatively connected to a first shaft having a first end and an opposing second end and a second shaft having a first end and an opposing second end, a first reel disposed on a first end of the first shaft and a second reel disposed on a first end of the second shaft. The drive mechanism is adapted to impart rotation to the first and second reels through the first and second shafts such that the first and second reels receive and wind the tape strands upon the reels, and advance the assembly of imbricated bags along the drive path from the upstream end to the downstream end. The first and second reels are both disposed on a face of the housing and oriented in a plane spaced from and parallel to the longitudinal axis of the housing.

Alternatively, the present invention is directed to a taped bag feeder having a drive mechanism further comprising a ratchet shaft having a first end and an opposing second end, and positioned between and operationally connected to the first and second shafts such that the first shaft is operationally connected to the second shaft by means of the ratchet shaft.

The present invention is a taped bag feeder comprising drive mechanism further including a differential unit positioned between the second end of the first shaft and a first end of a third shaft, and configured to maintain a substantially equal torque loading on the first and second shafts. The first and third shafts are operationally connected to the differential unit and along a common longitudinal axis therethrough.

The present disclosure is a taped bag feeder having a drive mechanism further comprising a pneumatic cylinder pivotally connected adjacent to a first end of a ratchet shaft such that the pneumatic cylinder imparts rotational motion to the ratchet shaft.

The present disclosure is directed to a taped bag feeder having a drive mechanism further comprising a means for transferring motion from a third shaft to a second shaft. Preferably, the means for transferring motion from a third shaft to a second shaft includes a first gear positioned on an opposing second end of a third shaft and a second gear positioned on an opposing second end of a second shaft.

The present disclosure is directed to a taped bag feeder having a drive mechanism which may further comprise a means for maintaining rotation of a first shaft, a second shaft and a third shaft, all in one direction. Preferably, the means for maintaining rotation of a first shaft, a second shaft and a third shaft, all in one direction, includes a third gear positioned on an opposing second end of a ratchet shaft.

Additional features will become apparent to those skilled in the art upon consideration of the following detailed description of drawings, illustrative of at least one embodiment of the disclosure.

DETAILED DESCRIPTION OF PREFERRED EMBODIMENTS

While the present disclosure will be described fully hereinafter with reference to the accompanying drawings in which a particular embodiment is shown, it is understood at the outset that persons skilled in the art may modify the disclosure herein described while still achieving the desired result of this disclosure. Accordingly, the description which follows is to be understood as a broad informative disclosure directed to persons skilled in the appropriate arts and not as limitations of the present disclosure.

Figure 1:
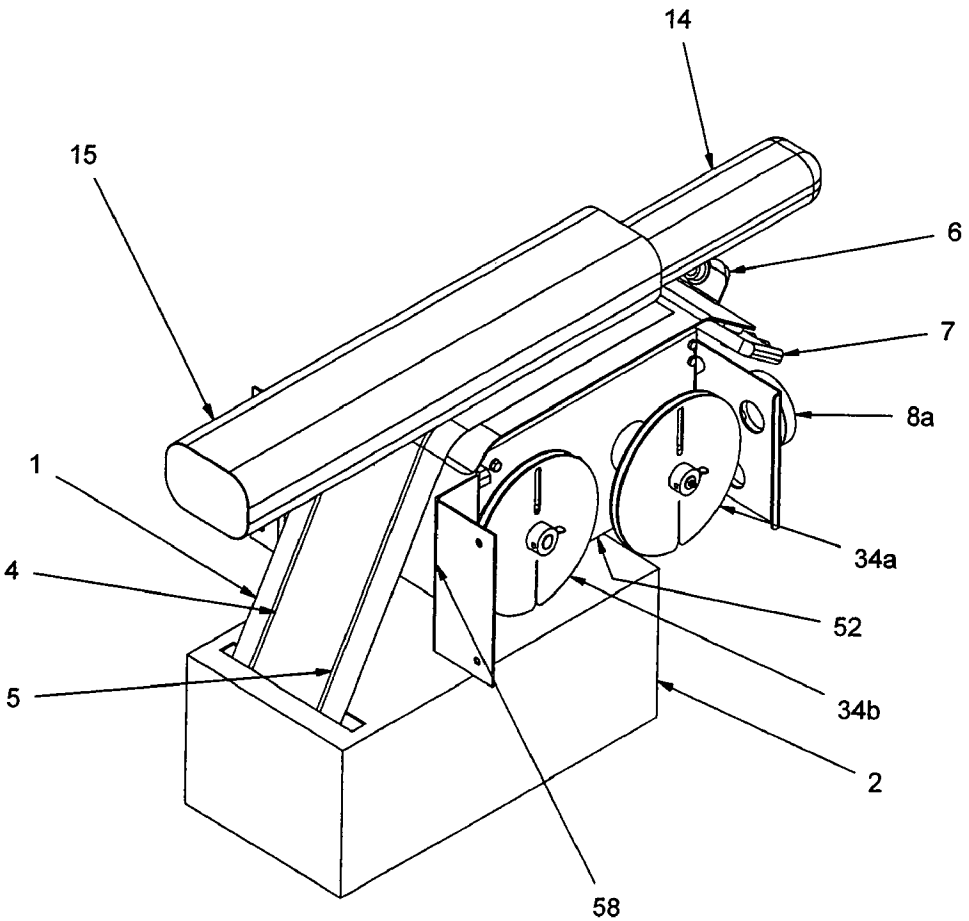
FIG. 1 is a perspective view of a taped bag feeder of the present disclosure showing the operator side.
Figure 2:
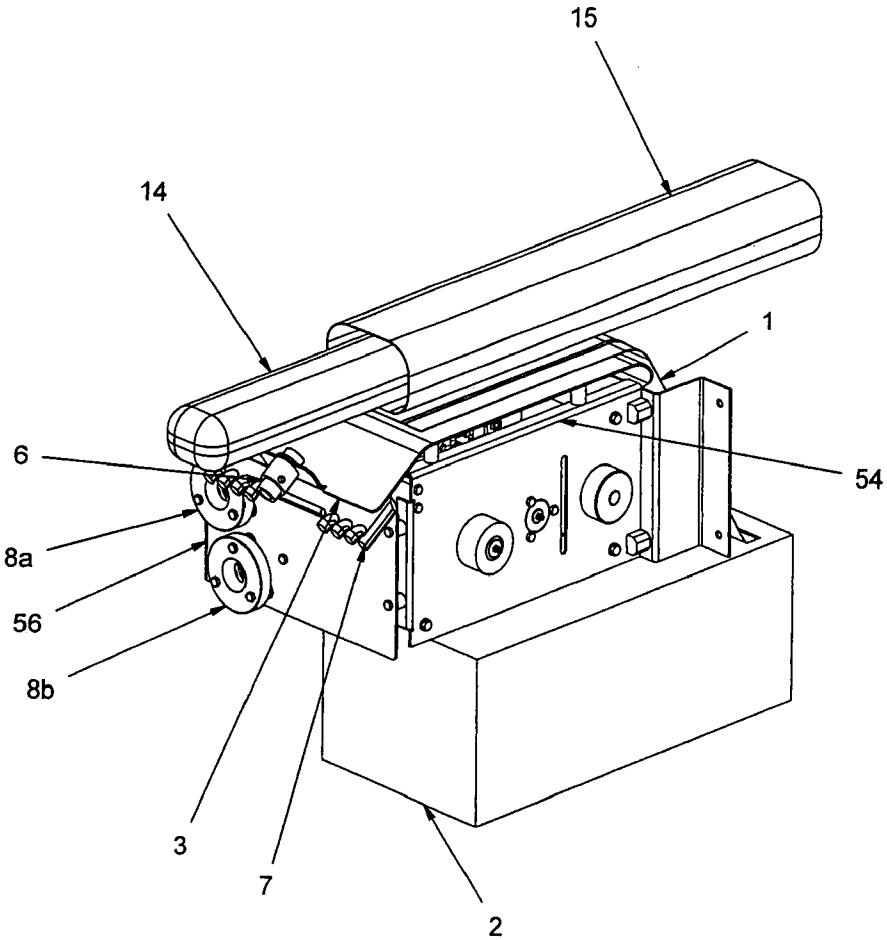
FIG. 2 is a perspective view of the taped bag feeder of FIG. 1 disclosure showing the non-operator side.

Referring to FIGS. 1 and 2, an embodiment of the taped bag feeder of the present disclosure has a housing with an operator-side panel 52, a non-operator side panel 54, an upstream panel 56 and a downstream panel 58. Taped bags 1 may be loaded into the feeder from an external source, such as a box 2 or a reel (not shown). The bag train is brought over the top of the bag guide 3 with the tape strands 4, 5 facing down so the bags can be opened from the top with an air amplifier or nozzle 6. Tape guide 7 has a number of openings, channels, slots, grooves, or the like, positioned side-by-side to receive tape strands 4, 5 spaced at typical dimensions, as is generally known in the packaging industry. The two tape strands 4, 5 are then placed in the appropriate spacing of the tape guide 7 to keep the two tapes parallel.

Tape guides 8*a*, 8*b* are positioned to correspond to the take-up reels 34*a*, 34*b*, respectively. Take-up reels 34*a* and 34*b* are horizontally offset from each other to prevent interference between the tape strands, therefore tape guides 8*a* and 8*b* are offset to align with their corresponding take-up reel.

From the tape guide 7, the tape gets threaded through the aperture in the round tape guides 8*a*, 8*b* located inline with two take-up reels 34*a*, 34*b*.

A knot is tied in the end of each tape strand 4, 5 and slid into the slot 11 on reel 10, knot facing out. The tape 4 that is threaded through the round tape guide 8*a* gets attached to the corresponding inline reel 34*a*. Tape 5 runs through the second round tape guide 8*b* and gets attached to the second reel 34*b*.

To start, the bags 1 should be located behind the switch actuator 13 (see FIG. 3), which protrudes from the bag guide 3. If bags 1 are located over the top of the switch actuator 13 (see FIG. 3), several bags should be removed from the two strands of tape 4, 5 to ensure the bags 1 will be in the correct position during the first cycle.

The tape bag feeder advances bags 1 forward as an operator or machine moves product 14 into the opened bag 15 on the bag guide 3. Bags 1 are opened by use of a compressed gas stream. In the embodiment shown, a pneumatically operated air amplifier or nozzle 6 is focused towards the bag opening. The bag 15 to be filled is popped open from the air turbulence as the lower portion of the bag is held by the two pieces of tape 4, 5. As bag 15 is removed, the switch actuator 13, which was held down by the just removed bag, tips upward, prompting advance switch 18 to activate.

Figure 3:
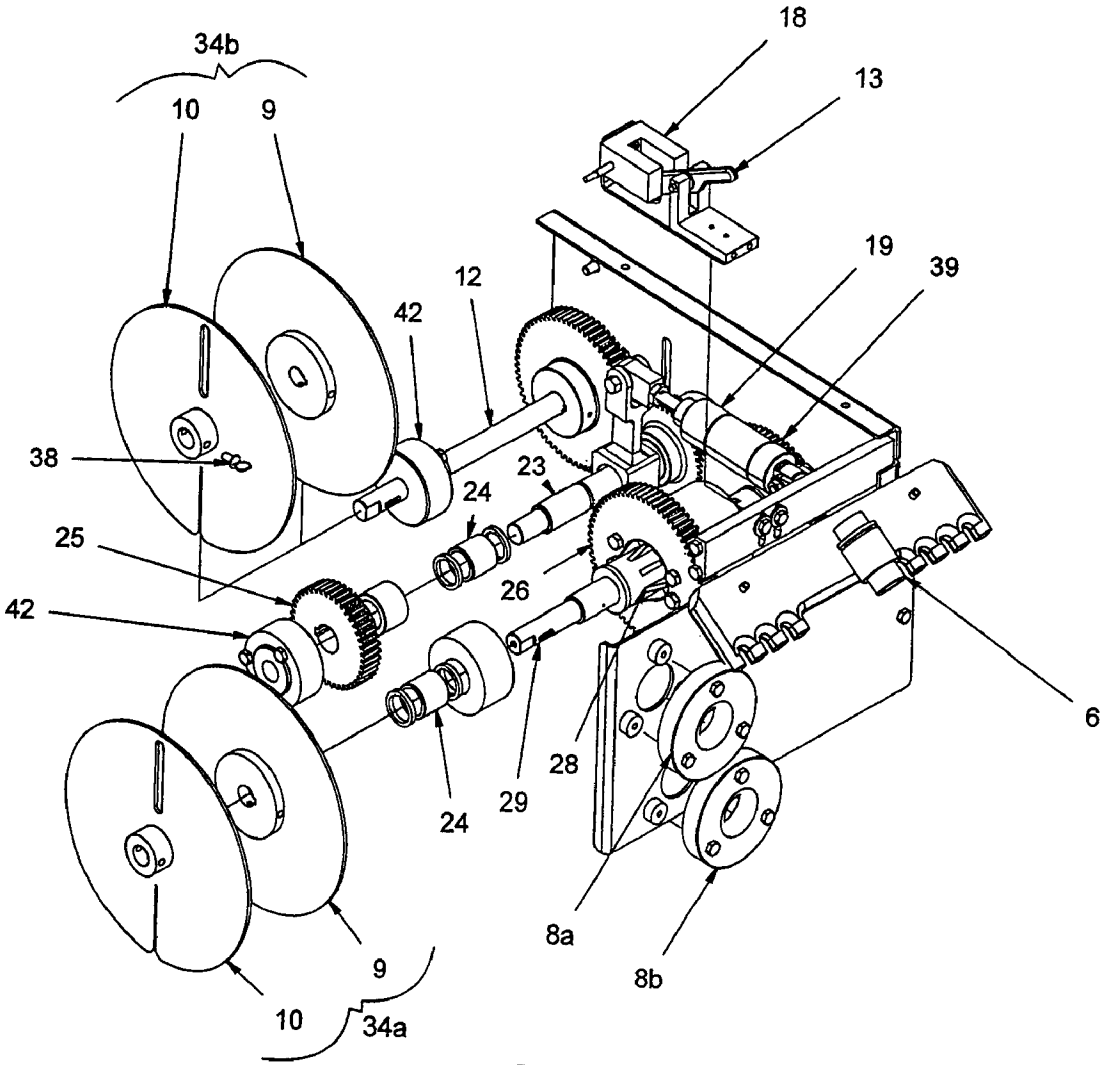
FIG. 3 is an exploded view of the drive mechanism for the taped bag feeder of FIG. 1 taken from the operator side.
Figure 4:
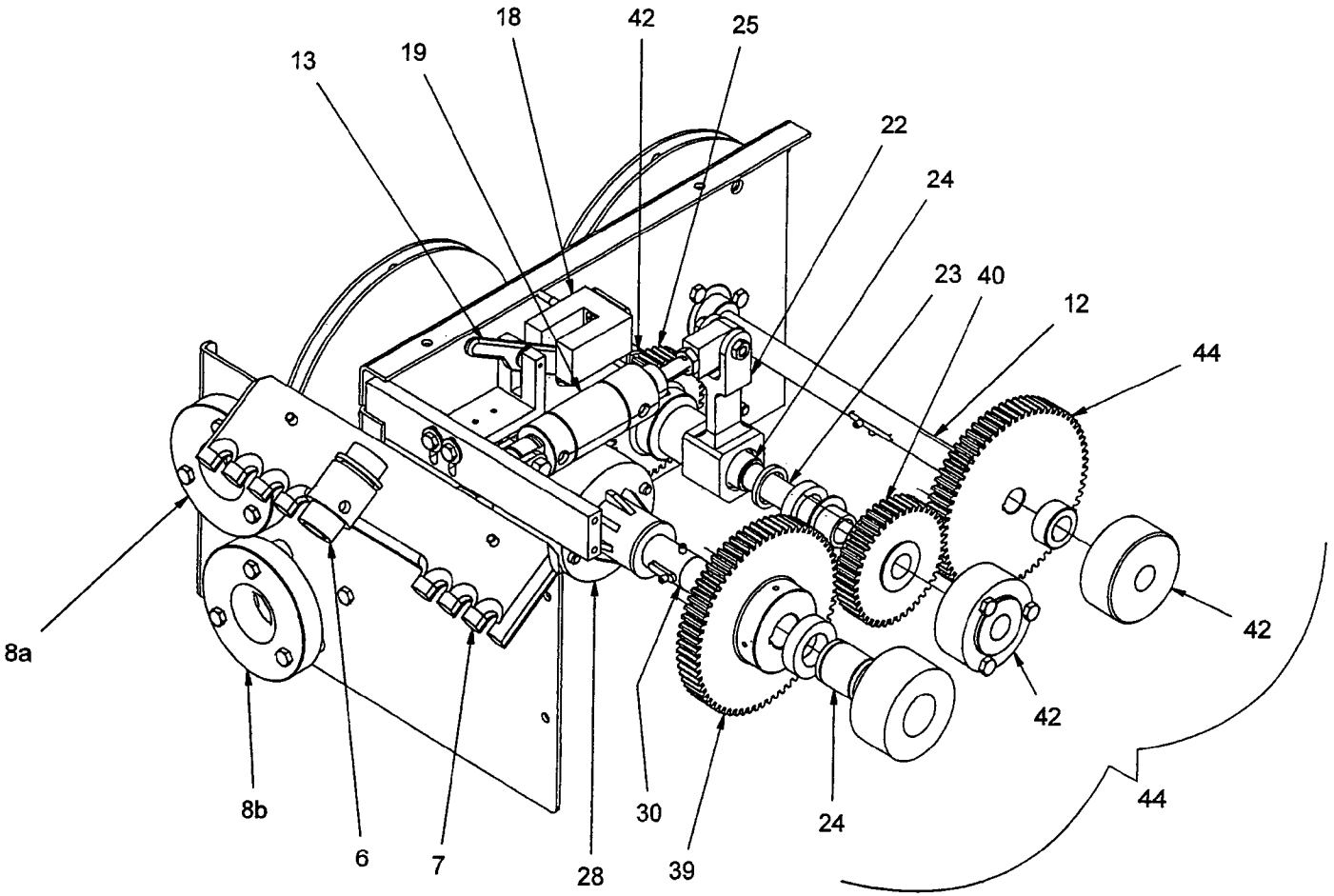
FIG. 4 is an exploded view of the drive mechanism for the taped bag feeder of FIG. 1 taken from the non-operator side.

Referring now to FIGS. 3 and 4, the switch actuator 13 being in the upper position causes pneumatic cylinder 19 to advance by way of an electronic solenoid valve or air operated logic switch, both of which are generally known in the art. A dual acting air cylinder 19 is given brief bursts of air, alternating between ports 20 and 21, rotating the pivot arm 22 forward and back. Pivot arm 22 is connected to the ratchet shaft 23 via a one-way needle clutch bearing 24. Bearing 24 grips the ratchet shaft 23 firmly in the push stroke and rolls freely in the opposite direction. Therefore, as the cylinder 19 actuates back and forth, the ratchet shaft 23 rotates in one direction advancing the downstream components. Ratchet shaft 23 is supported by two bearings 42, one on each end.

Figure 5:
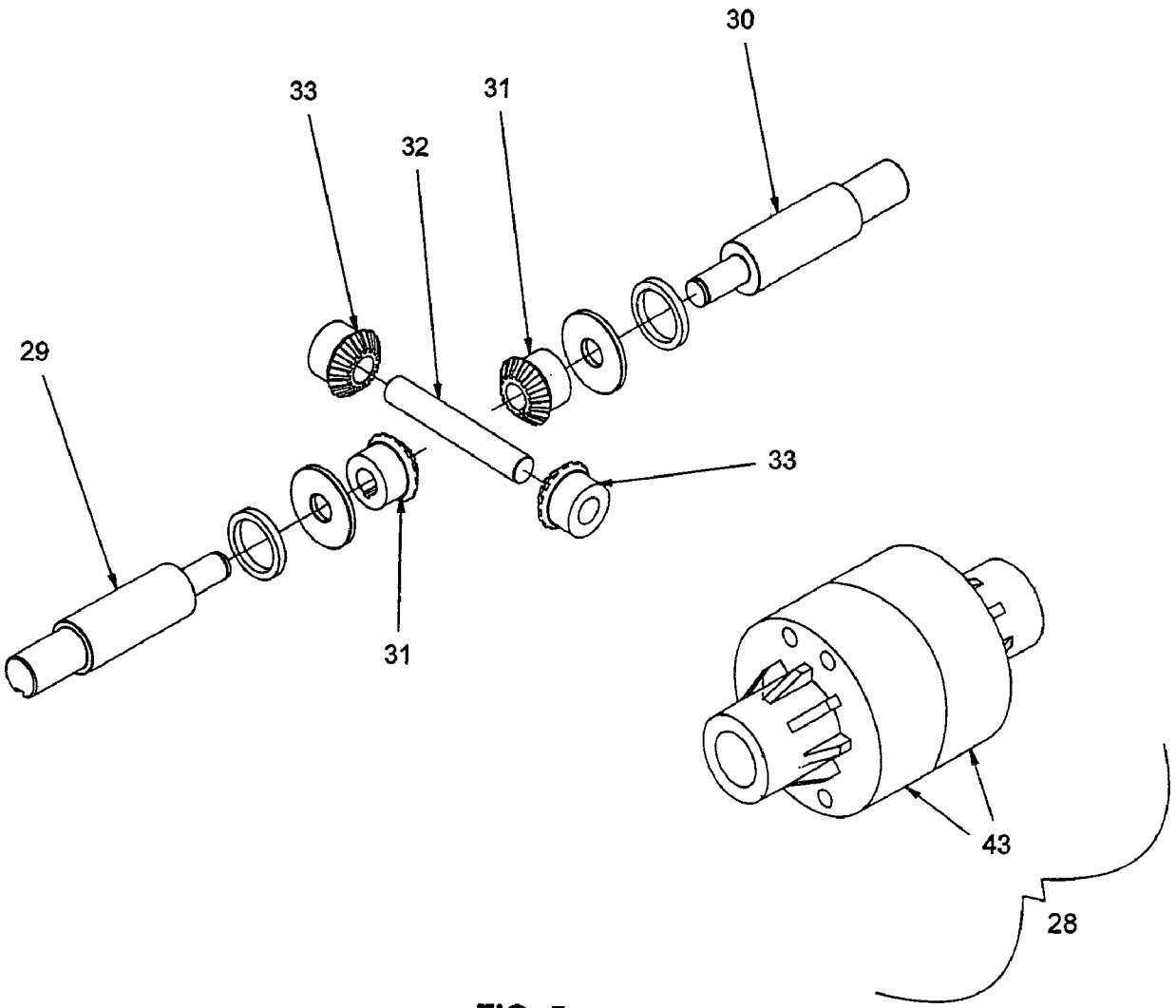
FIG. 5 is an exploded view of the differential assembly of the taped bag feeder of FIG. 1.

Firmly affixed to the ratchet shaft 23 is a spur gear 25. Gear 25 mates to another spur gear 26 attached to the outer housing of differential unit 28. Differential 28 consists of three shafts each with bevel gears incorporated into them, as is shown in FIG. 5. The two output shafts, primary 29 and secondary 30, have a bevel gear 31 affixed to their ends internal to the differential housing. Gears 31 mesh with bevel gears 33 on differential cross shaft 32, held in place by the differential housing. Shaft 32 is perpendicular to output shafts 29 and 30, and runs through the center of the differential 28. The two bevel gears 33 are free to rotate on the cross shaft 32. Therefore as the main spur gear 26 turns the outer housing of differential 28, both output shafts 29 and 30 rotate with the differential 28 as long as the output shafts 29 and 30 have similar torque loads. This is because equal loads are distributed through the gears 31 and 33 to the differential cross shaft 32, which turns with the differential 28. If one of the output shafts, for example shaft 29, is held in place as the differential 28 housing rotates, the other corresponding output shaft 30 turns twice as fast to allow the housing to continue moving. This happens as the internal bevel gears 33 now engage the non rotating output shaft 29. This creates the extra rotational speed as 50% of the movement comes from the housing differential 28 movement and the other 50% comes from the rotational movement of the internal bevel gear 33 relative to the non-rotating shaft 29. By use of such a differential 28, tensions between the two spaced tapes 4 and 5 can be kept the same. This equalization of tensions ensures the shingled bags 1 track properly through the taped bag feeder and allows variations in tape length to be accounted for.

Referring again to FIGS. 3 and 4, each of the output differential shafts 29 and 30 is supported by outboard one-way needle clutch bearings 24. Each of these bearings 24 ensures the shafts 29 and 30 do not rotate in the opposite direction, which could cause the tape 4, 5 on the reels 34*a*, 34*b* to become loose. The primary differential shaft 29 is connected to a backing plate 9 having a hub (not shown). A removable outer plate 10 attaches on the end of the primary output differential shaft 29 via a hand knob 38 or similar mechanism. Backing plate 9 and outer plate 10 cooperate to form a take up reel 34. The hub of backing plate 9 provides a gap with the outer plate 10 allowing tape 4 to be accumulated for disposal. The outer plate 10 has a slot 11 to accept a tape 4, 5 with a knot in the end. The knot gets placed on the outer side of the outer plate 10, so as to wind-up a length of tape 4, 5 as it is used up from the supply of bags 1. This allows for removal of tape 4, 5 after it has accumulated to the outer diameters of the reels 34*a*, 34*b*.

The secondary output differential shaft 30 has another spur gear 39 affixed to it. Gear 39 meshes with an intermediate spur gear 40 that rolls freely on the opposite end of the ratchet shaft 23. The purpose of this freely rotating gear 40 is to get the same rotational reference between the two tape take-up reels 34*a* and 34*b*. The intermediate spur gear 40 meshes with another spur gear 41 mounted on the secondary tape rewind shaft 12. The secondary tape rewind shaft 12 is attached to a second reel 34*b* to accept a second length of tape 5. It will be appreciated by those skilled in the art that first gear 39 positioned on an opposing second end of said third shaft 30 and second gear 41 positioned on said second end of said second shaft 12 provide the drive mechanism with a means for transferring motion 44 from said third shaft 30 to said second shaft 12.

While an embodiment has been illustrated and described in the drawings and foregoing description, such illustrations and descriptions are considered to be exemplary and not restrictive in character, it being understood that only an illustrative embodiment has been shown and described and that all changes and modifications that come within the spirit of the invention are desired to be protected. The applicant has provided description and figures which are intended as an illustration of certain embodiments of the disclosure, and are not intended to be construed as containing or implying limitation of the disclosure to those embodiments. There are several advantages of the present disclosure arising from various features set forth in the description. It will be noted that alternative embodiment of the disclosure may not include all of the features described yet still benefit from at least some of the advantages of such features. Those of ordinary skill in the art may readily devise their own implementations of the disclosure and associated methods that incorporate one or more of the feature of the disclosure and fall within the spirit and scope of the present disclosure as defined by the impendent claims.

The invention claimed is:

1. A taped bag feeder for supplying an assembly of imbricated bags having one or more tape strands removably attached thereto comprising:

(a) a housing having an upstream end, a down stream end and a longitudinal axis therebetween, said longitudinal axis defining a drive path;

(b) a drive mechanism operatively connected to a first shaft having a first end and an opposing second end, and an axis of rotation, and a second shaft having a first end and an opposing second end, and an axis of rotation;

(c) a first reel disposed on said first end of said first shaft which rotates about an axis of rotation in parallel with said axis of rotation of said first shaft, and a second reel disposed on said first end of said second shaft which rotates about an axis of rotation in parallel with said axis of rotation of said second shaft;

(d) wherein said first and second reels are each positioned on a face of said housing and oriented in a plane spaced from and parallel to said longitudinal axis; and (e) wherein said drive mechanism imparts rotation to said first and second reels through said first and second shafts such that said first and second reels receive and wind said tape strands upon said reels in the same direction of rotation, and advance said assembly of imbricated bags along said drive path from said upstream end to said downstream end, wherein said drive mechanism comprises a ratchet shaft, a differential unit and a pneumatic cylinder; wherein said ratchet shaft has a first end and an opposing second end and disposed between said first shaft and said second shaft such that said first shaft is operationally connected to said second shaft by means of said ratchet shaft; wherein said differential unit positioned between said second end of said first shaft and a first end of a third shaft; wherein said first and third shafts are operationally connected to said differential unit and along a longitudinal axis therethrough; wherein said differential unit is configured to maintain a substantially equal torque loading on said first shaft and said second shaft; wherein said pneumatic cylinder is pivotally connected adjacent to said first end of said ratchet shaft such that said pneumatic cylinder imparts rotational motion to said ratchet shaft.

2. The bag feeder of claim 1, wherein said drive mechanism further comprises a means for transferring motion from said third shaft to said second shaft.

3. The bag feeder of claim 2, wherein said means for transferring motion comprises a first gear positioned on an opposing second end of said third shaft and a second gear positioned on said second end of said second shaft.

4. The bag feeder of claim 1, wherein said drive mechanism further comprises a means for maintaining rotation of said first, second and third shafts in one direction.

5. The bag feeder of claim 4, wherein said means for maintaining rotation comprises a third gear positioned on said opposing second end of said ratchet shaft.

6. A taped bag feeder for supplying an assembly of imbricated bags having one or more tape strands removably attached thereto comprising:

(a) a housing having an upstream end, a down stream end and a longitudinal axis therebetween, said longitudinal axis defining a drive path;

(b) a drive mechanism comprising a ratchet shaft having a first end and an opposing second end and disposed between and operationally connected to a first shaft having a first end and an opposing second end, and an axis of rotation, and a second shaft having a first end and an opposing second end, and an axis of rotation; wherein said first shaft is operationally connected to said second shaft by means of said ratchet shaft;

(c) a first reel disposed on said first end of said first shaft which rotates about an axis of rotation in parallel with said axis of rotation of said first shaft, and a second reel disposed on said first end of said second shaft which rotates about an axis of rotation in parallel with said axis of rotation of said second shaft;

(d) wherein said first and second reels are each positioned on a face of said housing and oriented in a plane spaced from and parallel to said longitudinal axis; and (e) wherein said drive mechanism imparts rotation to said first and second reels through said first and second shafts such that said first and second reels receive and wind said tape strands upon said reels in the same direction of rotation, and advance said assembly of imbricated bags along said drive path from said upstream end to said downstream end.

7. The bag feeder of claim 6, wherein said drive mechanism further comprises a differential unit positioned between said second end of said first shaft and a first end of a third shaft; wherein said first and third shafts are operationally connected to said differential unit and along a longitudinal axis therethrough; wherein said differential unit is configured to maintain a substantially equal torque loading on said first shaft and said second shaft.

8. The bag feeder of claim 7, wherein said drive mechanism further comprises a pneumatic cylinder pivotally connected adjacent to said first end of said ratchet shaft such that said pneumatic cylinder imparts rotational motion to said ratchet shaft.

9. The bag feeder of claim 8, wherein said drive mechanism further comprises a means for transferring motion from said third shaft to said second shaft.

10. The bag feeder of claim 9, wherein said means for transferring motion comprises a first gear positioned on an opposing second end of said third shaft and a second gear positioned on said second end of said second shaft.

11. The bag feeder of claim 9, wherein said drive mechanism further comprises a means for maintaining rotation of said first, second and third shafts in one direction.

12. The bag feeder of claim 11, wherein said means for maintaining rotation comprises a third gear positioned on said opposing second end of said ratchet shaft.

13. A taped bag feeder for supplying an assembly of imbricated bags having one or more tape strands removably attached thereto comprising:

(a) a housing having an upstream end, a down stream end and a longitudinal axis therebetween, said longitudinal axis defining a drive path;

(b) a drive mechanism comprising:

i) a ratchet shaft having a first end and an opposing second end and disposed between and operationally connected to a first shaft having a first end and an opposing second end, and an axis of rotation, and a second shaft having a first end and an opposing second end, and an axis of rotation; wherein said first shaft is operationally connected to said second shaft by means of said ratchet shaft;

ii) a differential unit positioned between said second end of said first shaft and a first end of a third shaft; wherein said first and third shafts are operationally connected to said differential unit and along a longitudinal axis therethrough; wherein said differential unit is configured to maintain a substantially equal torque loading on said first shaft and said second shaft;

(c) a first reel disposed on said first end of said first shaft which rotates about an axis of rotation in parallel with said axis of rotation of said first shaft, and a second reel disposed on said first end of said second shaft which rotates about an axis of rotation in parallel with said axis of rotation of said second shaft;

(d) wherein said first and second reels are each positioned on a face of said housing and oriented in a plane spaced from and parallel to said longitudinal axis; and (e) wherein said drive mechanism imparts rotation to said first and second reels through said first and second shafts such that said first and second reels receive and wind said tape strands upon said reels in the same direction of rotation, and advance said assembly of imbricated bags along said drive path from said upstream end to said downstream end.

14. The bag feeder of claim 13, wherein said drive mechanism further comprises a pneumatic cylinder pivotally connected adjacent to said first end of said ratchet shaft such that said pneumatic cylinder imparts rotational motion to said ratchet shaft.

15. The bag feeder of claim 14, wherein said drive mechanism further comprises a means for transferring motion from said third shaft to said second shaft.

16. The bag feeder of claim 15, wherein said means for transferring motion comprises a first gear positioned on an opposing second end of said third shaft and a second gear positioned on said second end of said second shaft.

17. The bag feeder of claim 16, wherein said drive mechanism further comprises a means for maintaining rotation of said first, second and third shafts in one direction.

18. The bag feeder of claim 17, wherein said means for maintaining rotation comprises a third gear positioned on said second end of said ratchet shaft.

* * * * *